US005370053A

United States Patent [19]

Williams et al.

[11] Patent Number: 5,370,053

[45] Date of Patent: Dec. 6, 1994

[54] SLAPPER DETONATOR

[75] Inventors: Matthew R. Williams; Steven V. Werling, both of Fort Wayne, Ind.

[73] Assignee: Magnavox Electronic Systems Company, Fort Wayne, Ind.

[21] Appl. No.: 6,898

[22] Filed: Jan. 15, 1993

[51] Int. Cl.[5] ..... F42B 3/10; F42C 19/12

[52] U.S. Cl. ..... 102/202.5; 102/202.7; 102/202.9; 102/202.14

[58] Field of Search ..... 102/202.5, 202.7, 202.9, 102/202.12, 202.14, 204

[56] References Cited

U.S. PATENT DOCUMENTS

| | | | |
|---|---|---|---|
| 3,366,055 | 1/1968 | Hollander, Jr. | 102/202.5 |
| 4,421,030 | 12/1983 | Dekoker | 102/204 |
| 4,730,558 | 3/1988 | Florin et al. | 102/202.7 |
| 4,788,913 | 12/1988 | Stroud et al. | 102/202.5 |
| 4,862,803 | 9/1989 | Nerheim et al. | 102/202.5 |
| 4,938,137 | 7/1990 | Guay | 102/202.7 |
| 4,944,225 | 7/1990 | Barker | 102/202.5 |
| 5,074,035 | 12/1991 | Tyznik | 29/830 |
| 5,080,016 | 1/1992 | Osher | 102/202.7 |
| 5,088,413 | 2/1992 | Haber et al. | 102/202.5 |
| 5,216,325 | 6/1993 | Patel et al. | 343/595 |

*Primary Examiner*—Harold J. Tudor

*Attorney, Agent, or Firm*—John H. Crozier; Richard T. Seeger

[57] ABSTRACT

In a preferred embodiment, a slapper detonator, including: an inverted, vertical, open cup filled with an explosive, the mouth of the cup being adjacent the upper surface of a horizontally disposed explosive foil initiator (EFI); an integral flange extending circumferentially horizontally outwardly around the mouth of the cup; a cover plate having an opening defined therethrough and attached to the upper surface of the EFI, through which opening the cup extends vertically; and a counterbore defined around the perimeter of the opening to engage the flange and hold the mouth against the upper surface, such that lateral forces applied to the cup will be transferred to the cover plate. In another aspect of the invention, there is provided an EFI for a slapper detonator which has solderable electrical terminals. The EFI may be of laminated structure with the terminals laminated to the structure. In a further aspect of the invention, there is provided an improved barrel structure for an EFI.

8 Claims, 2 Drawing Sheets

SLAPPER DETONATOR

BACKGROUND OF THE INVENTION

1. Field of the Invention

The present invention relates to detonator devices generally and, more particularly, but not by way of limitation, to a novel slapper detonator of novel design and improved manufacturability.

2. Background Art

A detonator is the heart of a system to set off explosive devices such as warheads and the like. Traditionally, a blasting cap or a hot bridge wire in contact with a relatively easily detonated primary explosive material is used to set off the ultimate secondary explosive material. These devices have minimum safety, since rather low level, spurious electrical currents can activate the blasting cap or bridge wire. To overcome the above safety problem, the exploding bridge wire system was developed in which a large current is applied to a bridge wire, rapidly heating it and causing it to explode.

In a further development, the exploding bridge wire is replaced with a slapper detonator which includes an exploding foil which forms part of a laminated printed circuit board type structure. When a large electrical current is passed through the foil, it rapidly explodes, or vaporizes, causing a plastic layer to "slap" against an explosive, thus detonating the explosive. Such slapper detonators have thus far been connected to a capacitive energizing circuit by means of bulls-eye connector or other types of compression mechanical connectors. Such electrical connectors add cost and extra parts to the structure and also are unreliable over time. Also, it is desirable to keep the inductance of such devices as low as possible, but mechanical connectors add inductance to the devices.

Accordingly, it is a principal object of the present invention to provide a slapper detonator of improved construction.

It is a further object of the invention to provide such a slapper detonator that employs other than mechanical connectors.

It is another object of the invention to provide such a slapper detonator that can be surface mounted on a printed circuit board.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment a slapper detonator, comprising: an inverted, vertical, open cup filled with an explosive, the mouth of said cup being adjacent the upper surface of a horizontally disposed explosive foil initiator (EFI); an integral flange extending circumferentially horizontally outwardly around said mouth of said cup; a cover plate having an opening therethrough and attached to said upper surface of said EFI, through which said opening said cup extends vertically; and a counterbore defined around the perimeter of said opening to engage said flange and hold said mouth against said upper surface, such that lateral forces applied to said cup will be transferred to said cover plate.

In another aspect of the invention, there is provided an EFI for a slapper detonator of the type having an inverted, vertical, open cup filled with an explosive, the mouth of said cup being adjacent the upper surface of horizontally disposed said EFI, said EFI having electrical connections thereto comprising: solderable electrical connections. The EFI may be mounted to a flat surface which may be a printed circuit board.

In a further aspect of the invention, there is provided an EFI for a slapper detonator of the type having an inverted, vertical, open cup filled with an explosive, the mouth of said cup being adjacent the upper surface of horizontally disposed said EFI, said EFI comprising:

(a) a horizontal, electrically conductive foil layer;
(b) a horizontal flyer layer superjacent said foil layer;
(c) a first structural layer superjacent said flyer layer;
(d) a second structural layer superjacent said first structural layer;
(e) a barrel defined by generally coaxially aligned first and second openings of similar shape defined through said first and second structural layers, respectively, said barrel being provided for the passage therethrough of a portion of said flyer layer to slam against said explosive; and
(f) said second opening being larger than said first opening so as to accommodate any misalignment of said first and second structural layers during manufacture of said EFI, so that the area of said first opening is not diminished by said any misalignment.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
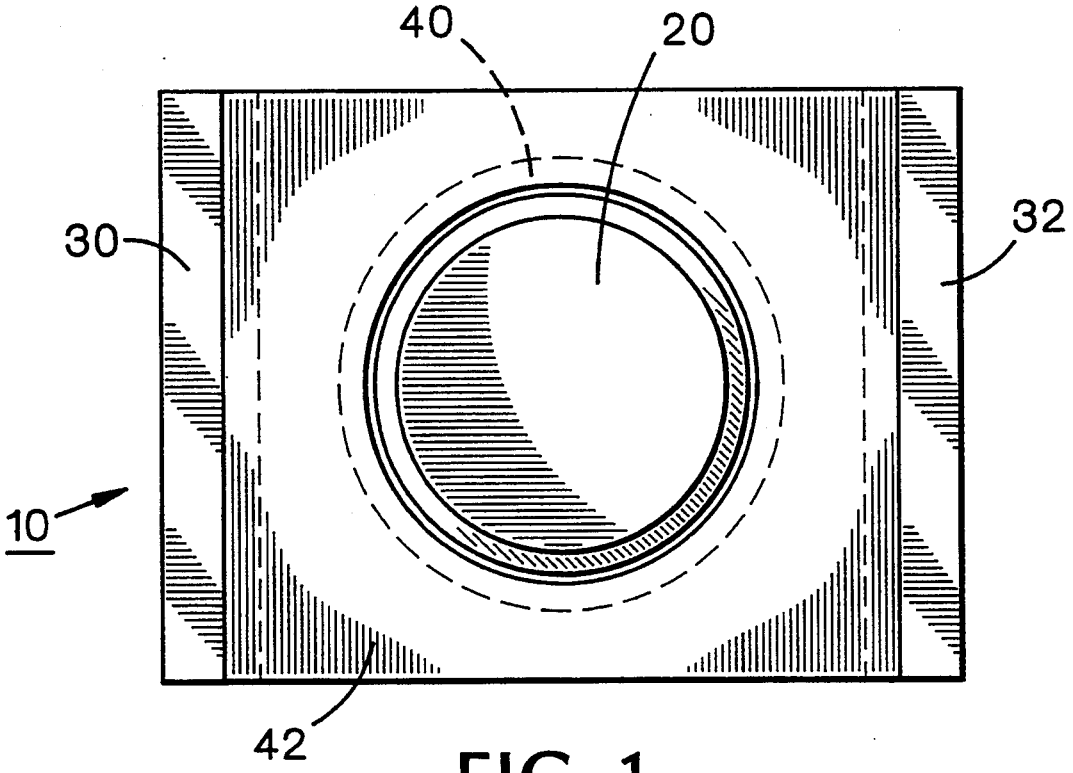
FIG. 1 is an enlarged top plan view of a slapper detonator according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
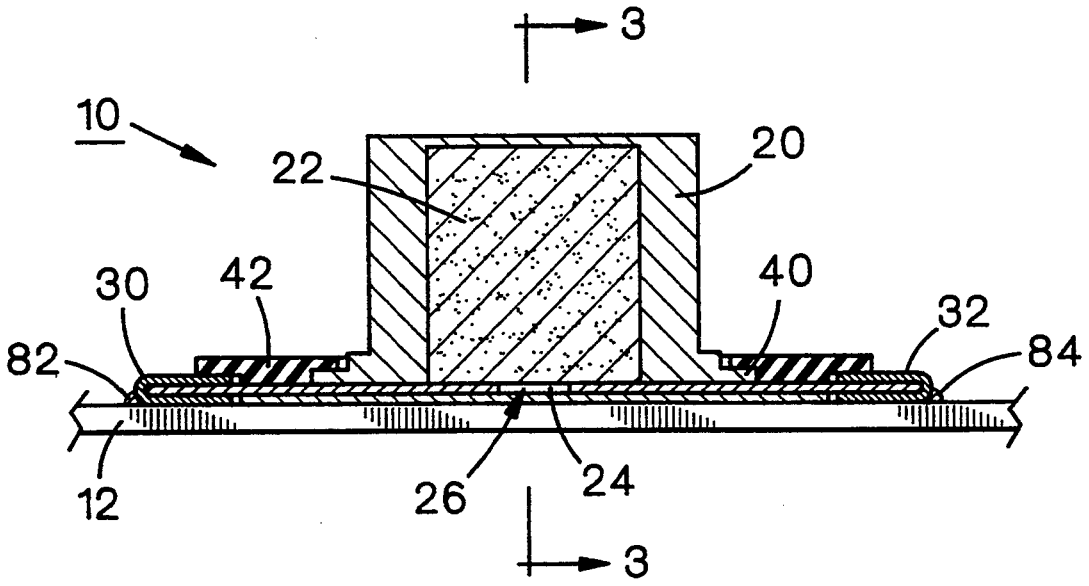
FIG. 2 is an enlarged side elevational view, in cross-section, of the slapper detonator.

Turning first to FIGS. 1 and 2, there is illustrated a slapper detonator, generally indicated by the reference numeral 10, which may be adhesively mounted on a printed circuit board 12 (FIG. 2). Printed circuit board 12 may contain the electrical circuitry for activating slapper detonator 10. Slapper detonator 10 includes an inverted stainless steel or aluminum cup 20 which is filled with an explosive 22 (FIG. 2) and which is adhesively attached to an explosive foil initiator (EFI) 24 (FIG. 2). An air-filled barrel 26 is defined in EFI 24. The construction details of EFI 24 are discussed below, but it is generally a laminated structure manufactured using printed circuit board manufacturing techniques. Two, low-inductance, phosphor-bronze terminal clips 30 and 32 are bonded to EFI 24 during the lamination process and can be soldered to printed circuit board 12.

At the lower end of cup 20 and extending circumferentially outwardly therefrom is a horizontal flange 40. A rectangular, plastic cover plate 42 having a counterbored central opening fits over and engages flange 40 and is adhesively attached to EFI 24. This arrangement dramatically increases the bonding area and any lateral loads applied to cup 20 are transferred to cover plate 42, increasing the load resisting capability of slapper detonator 10.

Figure 3:
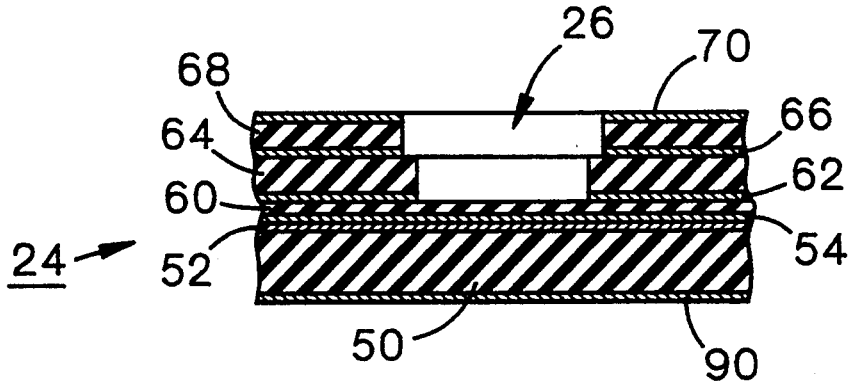
FIG. 3 is a greatly enlarged fragmentary side elevational view taken along line "3—3" of FIG. 2.

Reference should now be made to FIG. 3 for an understanding of the construction details of EFI 24. As noted above, EFI 24 is manufactured using the lamination techniques of printed circuit board manufacture. EFI 24 includes a first, relatively thick, plastic "tamper" layer 50 having thereon a superjacent layer of adhesive 52. Superjacent adhesive layer 52 is a copper foil 54. Superjacent copper foil 54 and chemically bonded thereto is a plastic "flyer" layer 60. Superjacent flyer layer 60 are, in order, an adhesive layer 62, a first plastic structural layer 64, an adhesive layer 66, a second plastic structural layer 68, and an adhesive layer 70, to which adhesive layer 70 terminal clips 30 and 32 (FIGS. 1 and 2) are bonded during the lamination process.

In manufacture, the components of EFI 24 are placed as shown on FIG. 3, with terminal clips 30 and 32 (FIGS. 1 and 2) in place, and then the components are laminated together in a press.

Still referring to FIG. 3, it can be seen that barrel 26 is stepped with a wider upper portion and a lower narrower portion. This arrangement is made to accommodate any misalignment of plastic layers 64 and 68, so as to maintain the full design open area of the lower portion of barrel 26.

After lamination, a solder dip operation provides positive electrical contact between terminal clips 30 and 32 and copper foil 54.

Slapper detonator 10 can now be adhesively attached to printed circuit board 12 (FIG. 2) by means of a layer of an adhesive layer 90 (FIG. 3. Alternatively, slapper detonator can be mounted to printed circuit board by means of soldering terminal clips 30 and 32 (FIGS. 1 and 2) with beads of solder 82 and 84 (FIG. 2). In either case, slapper detonator 10 and printed circuit board 12 are then encapsulated in a suitable potting material (not shown).

Figure 4:
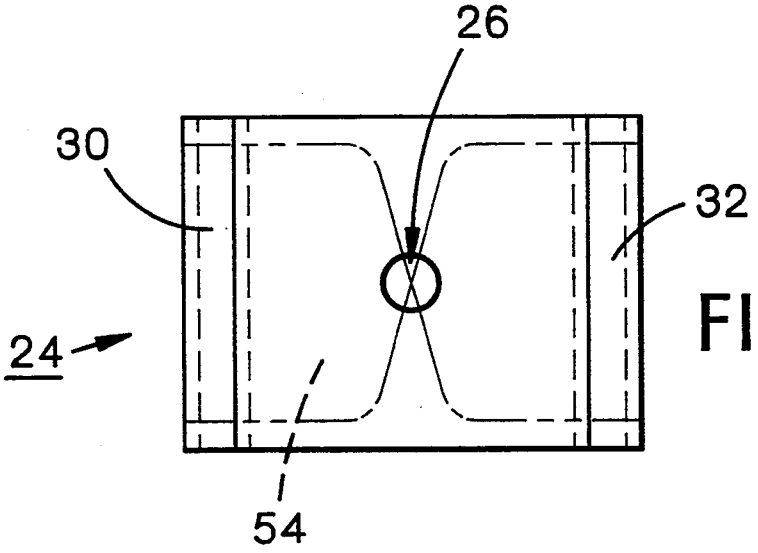
FIG. 4 is an enlarged top plan view of the explosive foil initiator of the slapper detonator.
Figure 5:
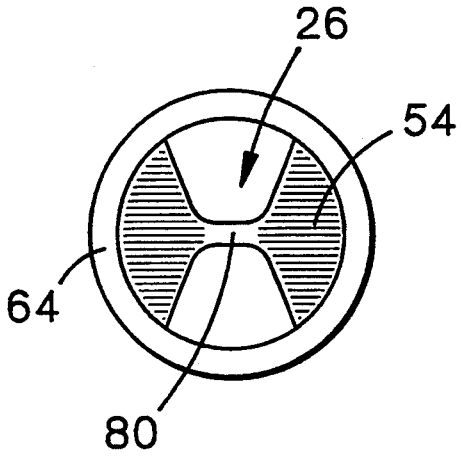
FIG. 5 is an enlarged top plan view of the barrel of the slapper detonator.

FIGS. 4 and 5 illustrate the configuration of copper foil 54 in which the end portions thereof are conductively attached to termination clips 30 and 32 along the lengths thereof (FIG. 4) and in which the center portion thereof constitutes a narrow bridge portion 80 (FIG. 5). Because plastic layer 60 is transparent, it is not identified on FIG. 5.

In use, when a voltage is applied across terminal clips 30 and 32 (FIG. 4), the resulting high current density across bridge portion 80 (FIG. 5) causes the bridge portion to rapidly vaporize, slapping a portion of flyer layer 60 (FIG. 3) against explosive 22 (FIG. 2), causing the explosive to detonate. This causes cud 20 (FIG. 2) to disintegrate and the top thereof to slam into the next explosive charge in the train of explosive charges.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. An explosive foil initiator for a slapper detonator having an inverted, vertical, open cup filled with an explosive, said explosive foil initiator is laminated and compromises:

(a) a horizontal tamper layer;

(b) a horizontal, electrically conductive foil layer superjacent said tamper layer, said foil layer having first and second edges;

(c) a horizontal flyer layer superjacent said foil layer;

(d) at least a first structural layer superjacent said flyer layer, said first structural layer having defined therethrough an opening disposed above said flyer layer; and (e) said electrically conductive foil layer having solderable electrical connections thereto for the structural attachment of said explosive foil initiator to a substrate, wherein said solderable electrical connectors comprise:

(i) first and second terminal clips disposed at said first and second edges, respectively, said first and second terminal clips being laminated to said laminated explosive foil initiator during a lamination process when said explosive foil initiator is manufactured; and (ii) said first and second terminal clips being adapted for the attachment thereto of electrical connections by soldering.

2. An explosive foil initiator, as defined in claim 1, wherein said explosive foil initiator is essentially flush mounted to a horizontal surface substrate.

3. An explosive foil initiator, as defined in claim 2, wherein said explosive foil initiator is structurally mounted to said horizontal surface substrate by means of an adhesive.

4. An explosive foil initiator, as defined in claim 2, wherein said explosive foil initiator is structurally mounted to said horizontal surface substrate by means of soldering said electrical connections thereto.

5. A laminated explosive foil initiator, as defined in claim 2, wherein said first and second terminal clips are soldered to said foil layer.

6. A laminated explosive foil initiator, as defined in claim 2, wherein said horizontal substrate is a printed circuit board containing circuitry to activate said slapper detonator.

7. An explosive foil initiator for a slapper detonator having an inverted, vertical, open cup filled with an explosive, said cup having a mouth adjacent an upper surface of horizontally disposed said explosive foil initiator, said explosive foil initiator comprising:

(a) a horizontal, electrically conductive foil layer;

(b) a horizontal flyer layer superjacent said foil layer;

(c) a first structural layer superjacent said flyer layer;

(d) a second structural layer superjacent said first structural layer;

(e) a barrel defined by generally coaxially aligned first and second openings of similar shape defined through said first and second structural layers, respectively, said barrel being provided for the passage therethrough of a portion of said flyer layer to slam against an explosive in a slapper detonator to which said foil initiator is attached; and (f) said second opening having a horizontal diameter larger than a horizontal diameter of said first opening so as to accommodate any misalignment of said first and second structural layers during manufacture of said explosive foil initiator, so that the area of said first opening is not diminished by said any misalignment.

8. A slapper detonator, comprising:

(a) a horizontally disposed explosive foil slapper initiator;

(b) an inverted, vertical, open cup filled with an explosive, said cup having a mouth adjacent an upper surface of said horizontally disposed explosive foil slapper initiator;

(c) an integral flange extending circumferentially horizontally outwardly around said mouth of said cup;

(d) a cover plate having an opening therthrough and attached to said upper surface of said explosive foil initiator, through which said opening said cup extends vertically; and (e) a counterbore defined around the perimeter of said opening to engage said flange and hold said mouth against said upper surface, such that lateral forces applied to said cup will be transferred to said cover plate.

* * * * *